US008661723B2

(12) United States Patent
Emde et al.

(10) Patent No.: US 8,661,723 B2
(45) Date of Patent: Mar. 4, 2014

(54) HANDGUN WITH OTHER DEFENSE AND UTILITY ELEMENTS

(75) Inventors: Dietmar Emde, Arnsberg (DE); Michael Swoboda, Möhnesee (DE)

(73) Assignee: German Sport Guns GmbH, Ense-Hoeingen (DE)

( * ) Notice: Subject to any disclaimer, the term of this patent is extended or adjusted under 35 U.S.C. 154(b) by 106 days.

(21) Appl. No.: 13/281,500

(22) Filed: Oct. 26, 2011

(65) Prior Publication Data

US 2012/0279105 A1 Nov. 8, 2012

(30) Foreign Application Priority Data

May 2, 2011 (DE) ..... 10 2011 050 041
Oct. 21, 2011 (DE) ..... 10 2011 054 723

(51) Int. Cl.
*F41C 23/22* (2006.01)

(52) U.S. Cl.
USPC ..... 42/71.02; 42/72; 42/90

(58) Field of Classification Search
USPC ..... 42/53, 90, 71.01, 71.02, 106
See application file for complete search history.

(56) References Cited

U.S. PATENT DOCUMENTS 545,528 A * 9/1895 Paul ..... 42/53
546,344 A * 9/1895 Prasse ..... 42/71.01
856,016 A * 6/1907 Balson ..... 42/71.01
894,101 A * 7/1908 Balson ..... 42/71.01
1,023,741 A * 4/1912 Kreith ..... 42/53
1,028,008 A * 5/1912 Eslick, Jr. ..... 7/168
1,231,058 A * 6/1917 Pansa ..... 42/53
2,098,139 A * 11/1937 Foley et al. ..... 42/106
4,062,117 A * 12/1977 Coleman ..... 30/317
4,209,870 A * 7/1980 Doyel ..... 15/97.1
D290,334 S * 6/1987 Reynolds, Jr. ..... D8/105
5,251,351 A * 10/1993 Klotz ..... 7/100
D365,163 S * 12/1995 Brogliato ..... D26/38
5,542,139 A * 8/1996 Boivin ..... 7/118
5,657,543 A * 8/1997 Collins ..... 30/367
6,044,257 A * 3/2000 Boling et al. ..... 455/404.2
6,226,510 B1 * 5/2001 Boling et al. ..... 455/404.2
6,389,729 B2 * 5/2002 Rauch et al. ..... 42/72
6,453,564 B1 * 9/2002 Foley ..... 30/359
6,536,152 B1 * 3/2003 Wisz ..... 42/71.01
6,666,566 B1 * 12/2003 Uke ..... 362/202
6,874,266 B1 * 4/2005 Kong ..... 42/71.01
7,028,874 B2 * 4/2006 Lin ..... 225/93
7,125,145 B2 * 10/2006 Gardiner et al. ..... 362/253
7,480,964 B2 * 1/2009 Vidal ..... 16/430
7,557,720 B2 * 7/2009 Rubin et al. ..... 340/574
7,637,049 B1 * 12/2009 Samson et al. ..... 42/108
7,937,871 B2 * 5/2011 Mantas ..... 42/49.01
D642,444 S * 8/2011 Kommer ..... D8/105
8,196,328 B2 * 6/2012 Simpkins ..... 42/73

(Continued)

*Primary Examiner* — Jonathan C Weber
(74) *Attorney, Agent, or Firm* — Michael Soderman

(57) ABSTRACT

A versatile handgun comprised of a weapon frame with a grip and at least one gun barrel and comprised of at least one additional defense element differing from the actual firearm function that is arranged on the grip of the weapon or that is housed in the grip of the weapon. The handgun is capable of making help available in an emergency situation and is capable in so doing of covering a very broad range of dangerous situations. The additional defense element(s) and various other pieces of emergency equipment, medical devices and/or tools could be housed in a slide-in element and different types of barrels could be used.

16 Claims, 6 Drawing Sheets

(56) References Cited

U.S. PATENT DOCUMENTS

2001/0011433 A1* 8/2001 Rauch et al. ..... 42/71.01
2004/0016058 A1* 1/2004 Gardiner et al. ..... 7/119
2004/0159033 A1* 8/2004 Rohrbaugh ..... 42/69.03
2010/0311387 A1* 12/2010 Cameron et al. ..... 455/404.2
2011/0072705 A1* 3/2011 Simpkins ..... 42/59
2011/0283588 A1* 11/2011 Samson et al. ..... 42/108

* cited by examiner

HANDGUN WITH OTHER DEFENSE AND UTILITY ELEMENTS

CROSS REFERENCE TO RELATED APPLICATIONS

This application claims the benefit of priority under 35 U.S.C. §119 of German Patent Application DE 10 2011 050 041.3 filed on May 2, 2011, and of German Patent Application DE 10 2011 054 723.1 filed on Oct. 21, 2011, the entire contents of which are incorporated herein by reference.

FIELD OF THE INVENTION

The present invention relates to handguns with additional features and, more particularly, to handguns with pieces of equipment, tools and devices stored on and in the grip, with a slide-in element in the grip and with different barrels.

BACKGROUND OF THE INVENTION

This invention involves a handgun comprised of a weapon frame with a grip and at least one gun barrel and comprised of at least one additional defense element differing from the actual firearm function that is arranged on the grip of the weapon or that is housed in the grip of the weapon.

A handgun of the type mentioned at the outset is known from US 2007/0086190 A1 and is called a multifunctional law enforcement tool there. A cartridge for a spray device is located in the grip in that weapon, so that a repellent can be sprayed out of openings in the barrel of the weapon. Other components of the spray device are housed in the barrel here; the barrel likewise includes a battery and lamps of a lighting device. The entire grip with the devices located in it can be pulled out of the remaining housing of the weapon in order to make the mechanisms of the spray device accessible or to make it possible to replace the cartridge in this known weapon. The grip of the weapon is closed at the bottom, though. Arranging a glass breaker on the bottom of the grip of the weapon is likewise known from this document. A disadvantage of the known weapon is that it can only be designed for spraying irritants based on the construction. The hollow space available in the grip of the weapon is only used for irritant storage and the mechanical elements of this function.

The invention is based on the problem of providing a handgun that is capable of making help available in an emergency situation as a basic principle and that is capable in so doing of covering a broader range of dangerous situations.

A handgun of the type mentioned at the outset with the features of Claim 1 provides a solution to this problem. Accordingly, there are provisions as per the invention for at least one additional defense element to be comprised of a belt cutter.

SUMMARY OF THE INVENTION

This invention involves a handgun comprised of a weapon frame with a grip and at least one gun barrel and comprised of at least one additional defense element differing from the actual firearm function that is arranged on the grip of the weapon or that is housed in the grip of the weapon; at least one additional defense element is comprised of a belt cutter in accordance with the invention. The additional defense element, of which there is at least one, and various other pieces of emergency equipment and/or tools can be housed in a slide-in element that can be pushed in from the bottom through an opening in a hollow space in the grip and that can be pulled out of this hollow space in the grip; the grip itself remains on the weapon frame, however.

BRIEF DESCRIPTION OF THE DRAWINGS

Further features and other advantages of the present invention will be apparent from the detailed description in connection with the accompanying drawings, in which.

DRAWINGS—REFERENCE NUMERALS

Figure 1:
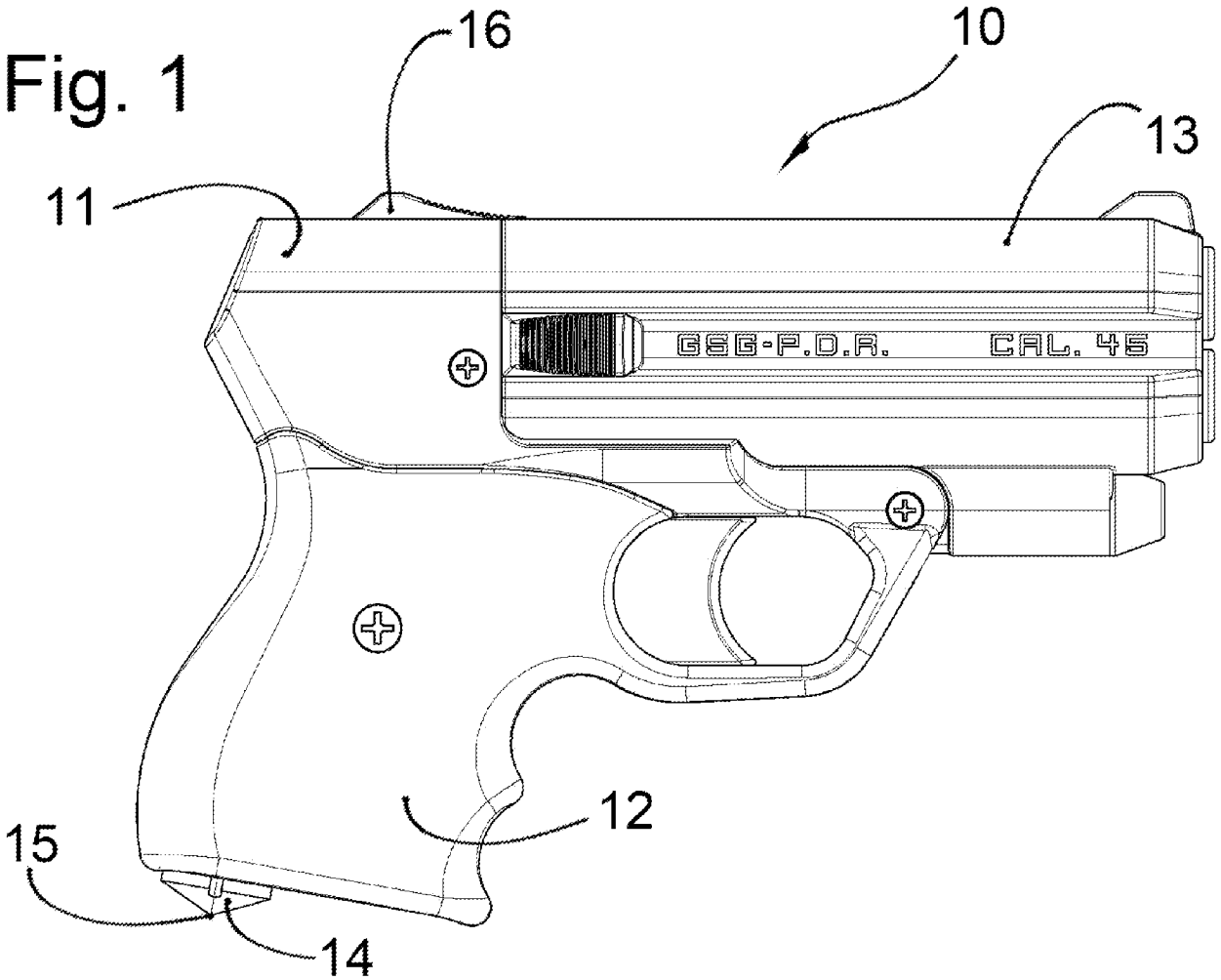
FIG. 1 shows a side view of a sample handgun in accordance with the invention with the example involving a pistol.

10 Handgun
11 Weapon frame
12 Grip
13 Barrel
14 Glass cutter
15 Tip
16 Unlocking lever
17 Joint
18 Trigger guard
19 Slide-in element
20 Belt cutter
21 Release lever
22 Slanted edge
23 Cutting gap
24 Twin-blade cutter
25 Serrated edge
26 Support fixture
27 Guide lug

DETAILED DESCRIPTION

In accordance with a further development of the invention or, as the case may be, an alternative solution variant of the inventive solution, there are provisions for at least one defense element to be attached to a slide-in element or to be housed in a slide-in element that can be pushed in from the bottom through an opening in a hollow space in the grip and that can be pulled out of this hollow space in the grip; the grip itself remains on the weapon frame, however. A preferred design solution of this kind makes it possible to house various pieces of equipment for emergency situations in or on a slide-in element of that type. This solution is flexible and more variable than the prior art, because a weapon housing with a frame, a grip and a barrel can be produced in the same way in principle by the manufacturer, for example, and slide-in elements of different types that are compatible with the same weapon type can then be housed in the hollow space in the grip or different variants of the weapon can be offered in which the same slide-in element holds different pieces of equipment.

The term handgun in the sense of this invention involves weapons which can be carried on the body of the user and used by a person with one hand or with both hands that permit a projectile charge comprised of at least one projectile type, selected from the group made up of projectile gases, projectile fluids, projectile particles, solid-powder projectiles and homogeneous solid projectiles, to be expelled in a well-directed way for at least a short distance of a few meters in a limited, targeted area.

Generic handguns are designed and constructed in the private area for self defense in emergency situations when there is acute danger to life and limb. Tear-gas pistols, pistols for shooting irritating liquids or pepper-spray pistols for shooting natural powders that strongly irritate the mucous membrane up to pistols with a particular man-stopping ammunition or customary lead ammunition are known, for instance; primarily the last two are only permitted to be delivered, possessed and used within the framework of the legal regulations, of course.

The inventors noticed that a pure handgun is not useful in an emergency situation like a car accident: the defense potential that is provided does not help in situations in which a user attempts, under shock and possibly in panic, to get out of a situation involving a confining, obstructive space.

In particular, with regard to the construction design for emergency situations that cannot be foreseen, it is only logical that a handgun of this type is constantly carried on one's body in a permanent and easily available way.

A belt cutter as per the invention is designed to reliably and quickly cut up flat belts that are a few millimeters thick, such as seat belts, lashing straps and even belts that are found in carrying systems and backpacks; it permits the quick, targeted severing of flat, broad, tightened, obstructing belts of that type.

The belt cutter as per the invention could be arranged to spring back, for instance, in a preferably lateral recess of a slide-in element that can be pushed into the hollow space of the grip.

A belt cutter of this kind has, as an advantage, a guide lug that makes it easier to position and lead in a cutting edge towards the flat belt and that advantageously makes the improper severing of thicker objects impossible.

It is particularly advantageous when the belt cutter as per the invention has a V-shaped mount with a manually inaccessible cutting gap with at least one cutting edge, preferably with several cutting edges arranged on two sides opposite one another in a tapering gap, with a particular preference for cutting edges with a serrated profile and/or a sawtooth shape.

The belt cutter can also, in accordance with a further development of the invention, be connected in an extendible fashion in the interior of the weapon frame, for instance, and/or have a force-actuated pull-in mechanism that can be activated, for instance, preferably arranged in a manually inaccessible cutting gap.

There are provisions in accordance with a preferred further development of the invention for at least two additional defense elements that are different from one another to be arranged on the grip of the weapon or in the grip of the weapon. They could be a belt cutter and a glass cutter, for example.

A handgun is being claimed for the first time in the combination described above that can be of universal service in emergency situations and that provides clear, lifesaving added value above and beyond the defense potential.

As an example, a glass breaker could be arranged on the side of the slide-in element turned away from the slide-in side, which corresponds to the bottom of the grip in the case of a pushed-in slide-in element and/or a belt cutter could be arranged on the slide-in element in such a fashion that it is located in the interior of the hollow space in the grip of the weapon when the slide-in element is pushed in and is no longer directly accessible from the outside.

The slide-in element could, for instance, be capable of being pulled out of the grip and/or pushed out of the grip via a spring mechanism after a lever or button arranged on the weapon, preferably in the area of or in the proximity of the trigger guard or on the side of the weapon, is actuated to make the additional defense means or emergency equipment accessible.

There are provisions in accordance with a preferred further development of the invention for at least one defense element and at least one tool or piece of emergency equipment, especially selected from the group made up of a knife, a compass, a signaling mirror, a whistle, a flint and a fish hook/fishing line, to be housed in the slide-in element or arranged on the slide-in element. The versatility of use of the hollow space in the weapon grip for the housing of various defense elements and pieces of emergency equipment, which make important tools available to the user in an emergency situation for survival, for instance in the wilderness, becomes clear here.

The tool in the sense of the statements above could also be a tool with multiple functions (a so-called "multi-tool") that is comprised, for instance, of a knife and/or a pair of combination pliers and/or a bottle opener and/or scissors and/or a screwdriver and/or a Philips screwdriver and/or a wood saw and/or a belt cutter and/or a wire cutter and/or a nail puller and/or a can opener.

In particular, in accordance with a further development of this invention in the grip of the weapon, at least one piece of emergency medical equipment, especially selected from the group made up of a suction pump, a syringe, an antidote, an anti-allergy agent, a disinfectant, wound dressing material and bandages, could be housed in the slide-in element or arranged on the slide-in element, for instance. The suction pump offers the possibility of sucking the poison out of the wound after a snakebite, for example. There could be a similar procedure with regard to stings from bees, wasps, spiders or scorpions or the like. An anti-allergy agent could be taken when there is hypersensitivity to insect stings or plant substances. An antidote could be injected with a syringe. The disinfectant could serve to disinfect a wound. After that, a dressing could be applied. The solution in accordance with the invention could consequently contain all of the necessary pieces of equipment for possible emergency medical situations in the slide-in element. The contents of the slide-in element could be varied any way one likes depending on the requirements of the user.

A further preferred development of the invention provides for the weapon to be equipped with an alarm button that will cause a signal to be sent out when it is actuated, preferably a signal to be located via satellite navigation (GPS) that is received by a reception station assigned to it. The user therefore has the possibility of sending out an emergency call in an emergency situation, after which the station receiving it is in a position via the GPS system to locate the person and to send out a rescue team, for instance, that picks up the person. This variant of the invention is especially advantageous when the person goes to a remote area far away from human settlements, for instance a desert region, an arctic region, a large forest area, a jungle or a steppe or the like.

Furthermore, there are provisions as a preference for the weapon as per the invention to have at least one barrel for shooting projectiles and/or at least one barrel for shooting irritant gas and/or at least one barrel or shooting flares. It could consequently not only be of service to the user in a close combat situation (irritant gas), but also when there is an attack by a wild animal, for instance, for which live ammunition could be shot from a distance. If the user gets into an emergency situation like a mishap, for instance, due to a fall in which she injures herself, as an example, she can call attention to herself by shooting flares. That is a useful alternative, especially if the user is not all that far from the next human settlement and if the weapon does not have the above-mentioned GPS function.

The handgun in accordance with the invention has, as a preference, at least two gun barrels; at least one gun barrel is selected from the group made up of a rifle barrel, a '45 rifle barrel, a shotgun barrel, a rocket barrel, a signaling-device barrel, a light-guide barrel, a slug barrel, a single-loader barrel, a multi-loader barrel, a smooth barrel, a grooved barrel, a polygon barrel, a conical barrel, a drop barrel, an insert barrel, an add-on barrel and an exchangeable barrel.

A possible preferred design variant of the invention provides for the weapon to have a drop barrel that can be tilted down towards the front and for the tilting mechanism to be triggered by means of a lever or slide arranged at the top of the rear area of the frame of the weapon, which can also simultaneously serve as a sight.

A drop barrel of that type advantageously permits the parallel lateral or three-point-bearing-based release of a gun barrel via a pivot link so that the drop barrel cannot be dropped or lost; with a particular preference, this allows the targeted disabling of a specific and possibly endangering defense potential and the reloading of single-loader barrels that have to be loaded from the back.

An exchangeable barrel with a different design, for example, that can be removed from the weapon, for instance by slicing the barrel forward (in the direction of a shot) and pulling it off. An exchangeable barrel of that type permits the installation and conversion of a barrel with an adjustment of the handgun to the new, additional functionality. An exchangeable barrel advantageously permits a tool-free, manual exchange of gun barrels with the same dimensions via a mechanical latch in the weapon body; used-up or worn-out gun barrels can be quickly and simply replaced by new gun barrels or gun barrels with a different functionality because of that without a readjustment of the weapon being necessary.

In accordance with a further development of the invention, there are provisions for a glass breaker that could be arranged on the side of the slide-in element turned away from the push-in side, for example, which corresponds with the bottom of the grip when the slide-in element is pushed in. A glass breaker of that type offers the user a further possibility to free himself from an emergency situation by smashing a pane of glass. Situations could arise, as an example, in which the user himself or a different person is confined in a building or in an elevator where extremely quick action is necessary, especially when a fire starts. The glass breaker then makes it possible to quickly smash a pane of glass.

A glass breaker of this type preferably has at least one tip that could also be hardened; the tip is comprised of a material selected from the group made up of a hardened alloy, ceramics, a sapphire, a diamond, natural hard material and synthetic hard material.

A hardened tip advantageously provides enormously high tension in the pane at a point when there is impact stress on the pane, which makes it possible to break brittle panes with significantly less force; the tip, in an especially preferred form, is at least partially made of a hard material that also permits a preparatory scratching of panes due to its high level of hardness and thus advantageously makes it even easier to bring about the fracture.

The glass breaker, as an example, could be connected to a triggerable, force-actuated pulse generator. A power boost is advantageously provided via a force-actuated pulse generator that makes it possible to break and open a pane even with one-hand operation with a low level of force. It is ensured in an especially advantageous way because of that after a car accident, as an example, that a passenger who may only be able to move in a limited way or a user with a low level of physical power will be capable of breaking a pane confining him with one hand with a low level of basic physical power despite his confinement. The pulse is advantageously actuated in a mechanical fashion via a spring or in a chemical fashion via a propellant or in an electromechanical fashion—via an ultrasonic pulse as a special preference. This takes place in an especially advantageous way in combination with a closed control loop that only releases this function when there is force-locking contact of the glass breaker and/or a repeated pulse stress at short intervals of time.

The glass breaker could also be connected to a triggerable, force-actuated turning gear, as an example. A turning gear of that type is advantageously constructed in combination with two hard-material tips arranged in different off-center ways to it. When contact is made with the pane to be broken, the rotary movement of the two tips cuts two breaklines that cross one another into the surface; a target fracture point is already provided at the crossing point of the grooves because of this with subsequent pulse stress and the pane can be broken in a significantly more reliable way and with less force. This feature is designed in an especially advantageous way in combination with a pulse generator in the handgun.

The belt cutter could have, as an example, a V-shaped mount with a manually inaccessible cutting gap with at least one cutting edge. The risk of injury to the user or to other persons is advantageously reduced because of the essentially V-shaped mount.

Several cutting edges arranged on two sides opposite one another in a tapering gap in the mount are especially preferred. The cutting performance when pressure is applied on one side is advantageously improved via edges that are advantageously ground on both sides and that are opposite one another, and this makes the severing of the belt possible in a single thrusting or pulling movement.

Cutting edges with a serrated profile and/or a sawtooth shape are provided as a special preference. A profile of that type in the area of the frictional resistance advantageously improves the cutting performance in the case of sawing cuts that are made via a repeated back-and-forth movement. A cutting edge arrangement is advantageously provided in this way in combination with limiting cutting edges ground on both sides that ensures improved cutting performance both in the case of a pressure cut and in the case of a sawing cut.

The belt cutter could also be connected in an extendible fashion in the interior of the weapon frame. The belt cutter consequently and advantageously does not obstruct the functionality of the weapon at first and can, if necessary—via a force-actuated mechanism as a special preference—be brought into a very visible and easy-to-manage operating position outside of the weapon frame. A mechanism of that type is coupled as a special preference to an ejection mechanism to disable gun barrels—exchangeable or drop barrels as a special preference—so that the projectiles with a high defense potential can at the very least no longer be triggered when the belt-cutter function is activated. Barrels for projectiles with a high defense potential are designed as a special preference to be self-sealing and will encapsulate—separate as a special preference—the area in the back containing an ignition charge and/or a propellant when the barrel is ejected or tilted, so that third parties can no longer inadvertently activate it after that.

The belt cutter could, as an example, have a force-actuated pull-in mechanism that can be activated, preferably arranged in a manually inaccessible cutting gap. A belt that is led in will first be subjected to clamping tension because of the pull-in mechanism and—preferably via sawtooth profiles—fixed in place with frictional resistance at the end that is led in. Subsequent movements will be geared down via a mechanical transmission ratio to reduce the path into a coupled cutting and pull-in movement along the area of frictional resistance so that the entire belt can be successively severed in a power-boosted fashion. A device of that type could be coupled to the weapon trigger as a special preference, so that the cutting mechanism—preferably a cutting mechanism supplied with an additional drive unit—can be used by actuating the trigger when the belt cutter is advantageously activated.

This invention is applicable to weapons of any caliber. They could, for instance, be weapons with live ammunition, air guns for lead or steel projectiles or even airsoft guns for shooting plastic beads that can be operated with pressurized gas, for instance (CO2 or a different one). The weapon in accordance with the invention could consequently also be a toy weapon in principle; the pieces of equipment housed in the weapon could be appropriately adapted to the needs of children in a case of that type.

It is understood that the features and advantages described above and the examples below are not to be interpreted in a limiting fashion. Advantageous additional features and additional feature combinations as explained in the description can be realized both individually and in different combinations within the framework of the independent claims in the subject matter being claimed without leaving the sphere of the invention.

The sub-claims involve preferred developments of the problem solution in accordance with the invention. Other advantages of the invention follow from the description of the examples below referring to the drawings that are involved.

Reference is made to FIG. 1 to start with. The handgun shown here is a pistol 10 with a weapon frame 11, with a grip 12 and with at least one gun barrel 13; a glass breaker 14 is located on the bottom of the grip 12 in this variant. The glass breaker projects from the bottom of the grip 12 and has a sharp tip 15 so that a glass pane can be smashed or scratched with it.

Figure 2:
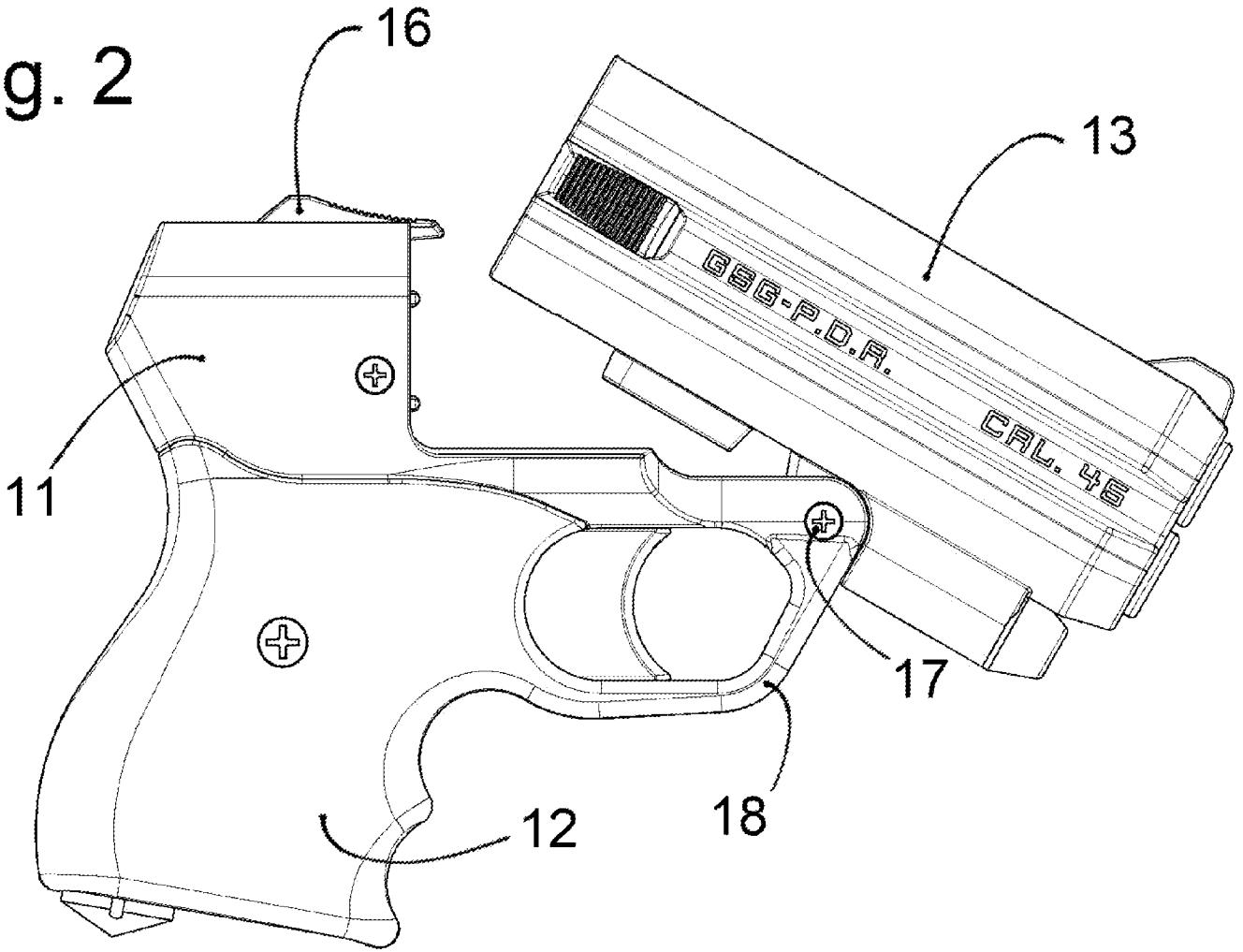
FIG. 2 shows another side view of the handgun of FIG. 1, but with a tilted barrel.

The belt cutter cannot be seen in FIG. 1 because it is in the interior of the weapon in this variant, as will be explained in more detail below. The barrel 13 can be tilted forward after actuation of an unlocking lever 16, as can be recognized in FIG. 2, but it remains in the process on the weapon frame 11, to which it is attached so as to be able to swivel around an axis on a joint 17 that is located in the upper part of the front area on the trigger guard 18.

Figure 3:
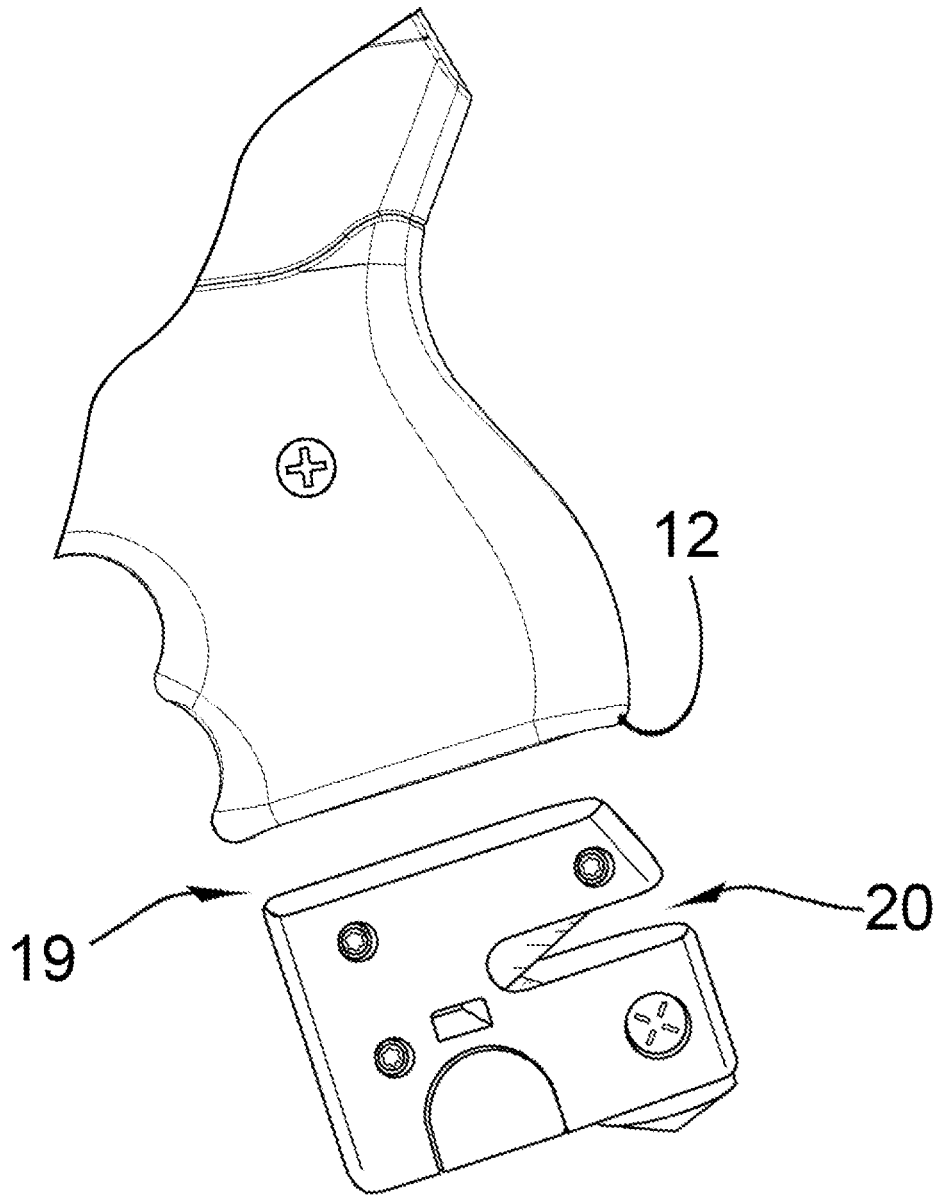
FIG. 3 shows a partial view of the weapon of FIG. 1 with the slide-in element pulled out of the grip.

The slide-in element 19 that the belt cutter 20 is on and that can be pushed into a hollow space in the grip 12 of the weapon will now be explained in more detail below with reference to FIG. 3. When the slide-in element 19 is pulled out, as in FIG. 3, the grip 12 is open at the bottom; this means that an opening exists into the hollow space in the interior of the grip that seats the slide-in element 19 in the functional state of the weapon (see FIG. 1). The slide-in element 19 can be pushed out so that it can be removed from the weapon grip 12 when this is initiated by a release lever 21 attached to the frame of the weapon; as an example, the lever is switched over or pressed in by the user for this purpose. The release lever could be attached to the weapon in a swiveling or sliding fashion. A spring mechanism, which is located in the interior of the grip 12 but not shown in FIG. 3, preferably provides support for pushing out the slide-in element 19.

Figure 4:
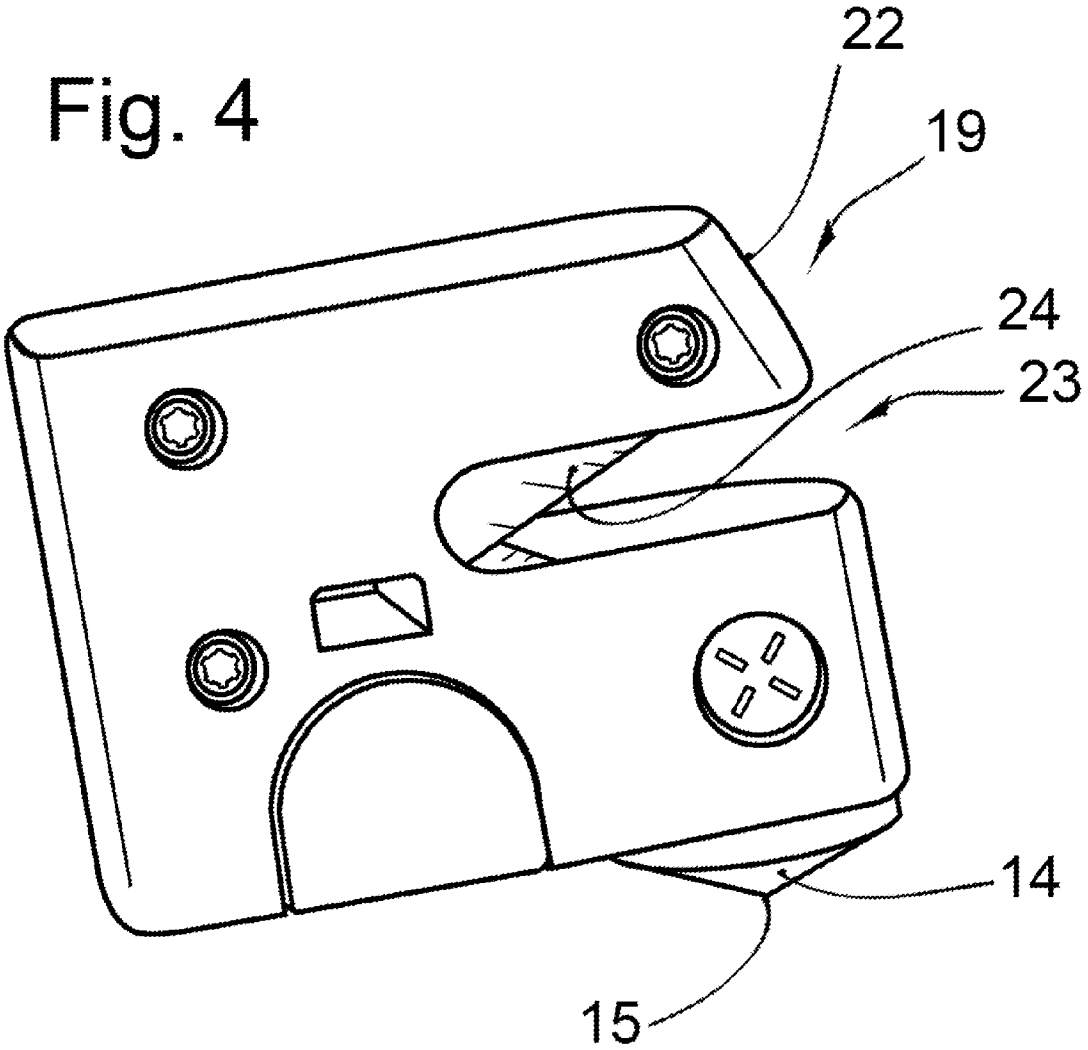
FIG. 4 shows an enlarged view of the slide-in element shown in FIG. 3 with a belt cutter and glass breaker.

Details of the slide-in element 19 are provided in its enlarged depiction in accordance with FIG. 4. The slide-in element has an approximately rectangular outline shape that has a slanted edge 22 at one corner. It is adapted in terms of its dimensions to the shape of the hollow space in the grip 12 with regard to its width in the crosswise direction and in the lengthwise direction and with regard to its shape, so it can be comfortably pushed into the grip. It has a manually accessible cutting gap 23 on one side that is an open gap towards the outside and that has the belt cutter 20 in the area of its inner end (and thus at the base of the gap). This belt cutter involves an asymmetric, V-shaped, twin-blade cutter 24, for instance, whose two cutters run at an acute angle vis-a-vis one another. If a belt is led into the cutting gap 23, it can be severed on the V-shaped twin-blade cutter. In so doing, the user grabs the side of the slide-in element 19 opposite the cutting gap and takes it in his hand like a tool. Since the twin-blade cutter 24 is deeply sunk into the cutting gap 23, there is no risk of injury from the blade for the user.

A long side of the slide-in element 19 can be seen in FIG. 4. The cutting gap described above is located at the one short side of the slide-in element. The glass breaker 14 is arranged on the bottom face of the slide-in element, so its tip 15 projects downwards and the tip consequently extends at approximately a right angle to the cutting gap 23 and projects out of the face of the slide-in element as an extension of the short side.

The cutting gap itself is formed as a roughly U-shaped recess on the short side in the body of the slide-in element; the twin-blade cutter 24 in the cutting gap 23 has a V-shaped arrangement, however.

The cutting edges of the cutter of the belt cutter could have a serrated profile and/or a sawtooth shape, for instance.

In the description of the handgun in accordance with this invention, "front side" describes the area on the muzzle side of the weapon, whereas "back side" or "user side" accordingly describes the side on which the user of a pistol stands when the weapon is aimed. Following this orientation, "top" describes the area of the weapon over the grip in which the barrel with a sight arranged "on the top" is located, whereas a grip area projecting over the hand holding it and possibly a protective guard of a trigger are arranged "on the bottom".

The grip with a symmetric profile advantageously permits both right-handed and left-handed persons to safely handle the handgun.

Figure 5:
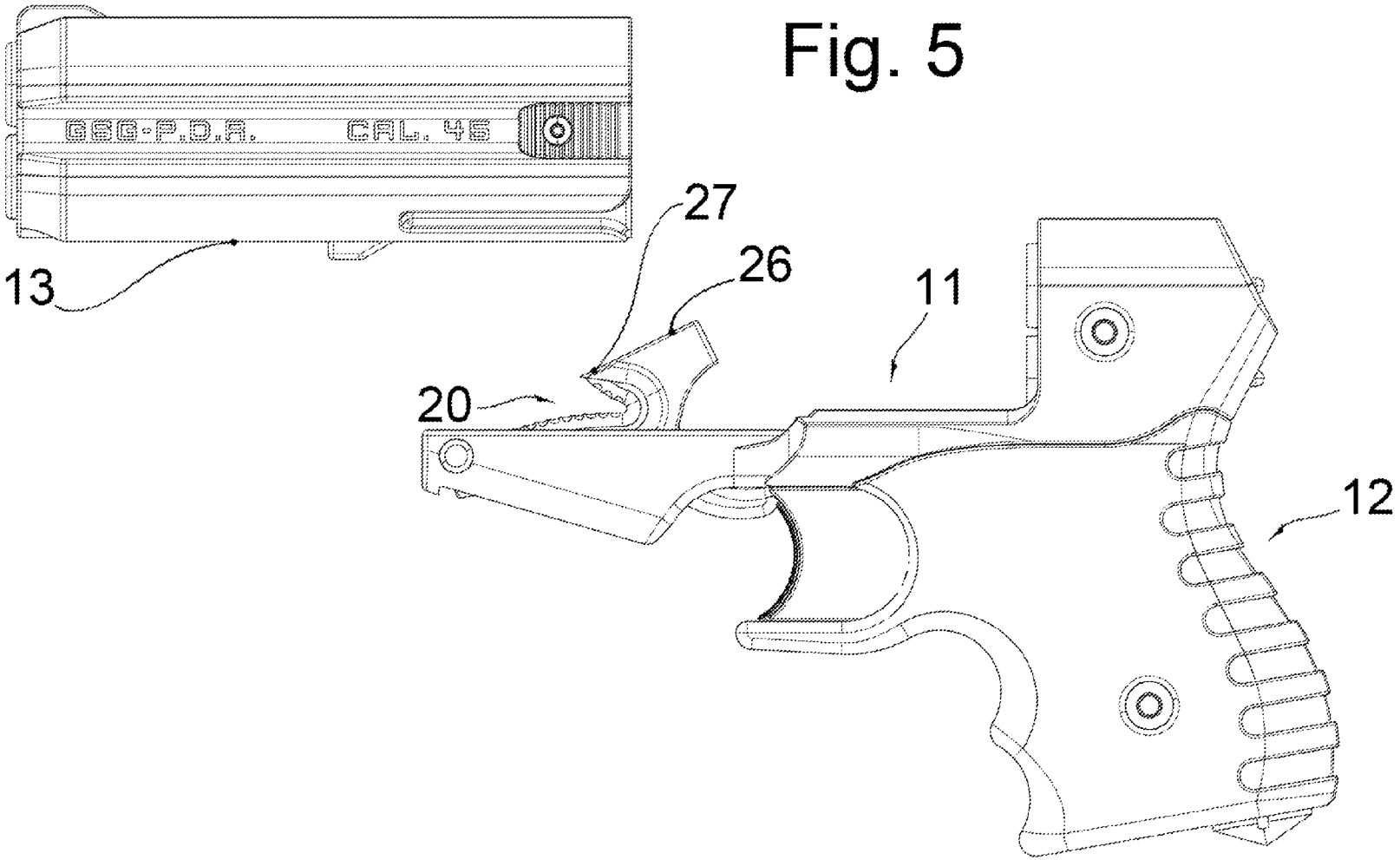
FIG. 5 shows an alternative variant of a handgun in accordance with the invention with a removable barrel.
Figure 6:
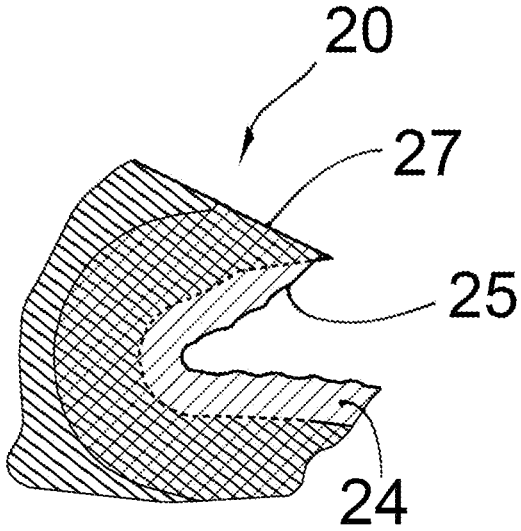
FIG. 6 shows an enlarged, detailed view of the belt cutter of the handgun of FIG. 5.

An alternative variant of this invention shown in FIG. 5 provides for the weapon to have a removable barrel 13 and for the belt cutter 20 to lie exposed after the removal of the barrel from the frame 11 of the weapon, as shown in FIG. 5. The belt cutter 20 also has a twin-blade cutter 24 roughly arranged in a V shape here that is open at the front. After the removal of the barrel, the user can consequently lead a belt that is to be severed into the cutting gap from the front and sever it. An enlarged view of the belt cutter 20 is shown in FIG. 6. The twin-blade cutter here has a serrated edge 25, as an example, and both of the cutters are at an acute angle vis-a-vis one another, so a type of V-shaped arrangement of the twin-blade cutter also results here.

The belt-cutting blade is fixed in place in a support fixture 26 surrounding it in the top, front area of the weapon frame 11. To create a secure holder for the belt cutter, the blade body could, as an example, be fixed in place in the support fixture 26 on the weapon frame with fittings like pins, rivets, passages and rear grips. The top area of the support fixture surrounds the blade body down to the cutting edge and forms a guide lug 27 at the top, which makes it possible to lead this along on a flat belt and consequently makes it possible to position and lead the belt into the V-shaped cutting edge. The risk of injury is prevented because the cutting edges are surrounded by the support fixture 26.

What is claimed is:

1. Handgun comprised of a weapon frame with a grip having a hollow space and at least one gun barrel, further comprising a removable slide-in element configured to be inserted into the hollow space of the grip and having at least two additional tool elements differing from one another and from the firearm function, a first tool element provided on the slide-in element is a belt cutter arranged within the hollow space of the grip of the weapon so that the belt cutter is not directly accessible when the slide-in element is inserted into the hollow space, and a second tool element provided on the slide-in element is a glass breaker arranged to be external to the hollow space when the slide-in element is inserted into the grip of the weapon and the glass breaker forms a portion of the external surface of the grip.

2. Handgun according to claim 1, characterized in that the slide-in element has a lateral recess, the belt cutter is capable of moving between an extended position and a recessed position within the lateral recess on the slide-in element, and a spring is attached between the belt cutter and the slide-in element to provide a force to return the belt cutter to the recessed position in the lateral recess.

3. Handgun according to claim 1, characterized in that the slide-in element is capable of being pulled out of the grip and/or pushed out of the grip via a spring mechanism after a lever or button arranged on the weapon is actuated.

4. Handgun according to claim 1, further comprising at least one defense element and at least one additional tool or piece of emergency equipment provided on or inside the slide-in element selected from the group consisting of a knife, a compass, a signaling mirror, a whistle, a flint, and a fish hook with fishing line.

5. Handgun according to claim 1, further comprising at least one piece of emergency medical equipment provided on or inside the slide-in element selected from the group consisting of a suction pump, a syringe, an antidote, an anti-allergy agent, a disinfectant, wound dressing materials and bandages.

6. Handgun according to claim 1, characterized in that the handgun is equipped with an alarm button that will cause a signal to be sent out when the alarm button is actuated.

7. Handgun according to claim 1, characterized in that the handgun has at least one barrel for shooting projectiles and/or at least one barrel for shooting irritant gas and/or at least one barrel for shooting flares.

8. Handgun according to claim 7, characterized in that the handgun has at least two gun barrels with the gun barrels individually or jointly having the design features of at least one barrel selected from the group made up of a rifle barrel, a '45 rifle barrel, a shotgun barrel, a rocket barrel, a signaling-device barrel, a light-guide barrel, a slug barrel, a cartridge barrel, a single-loader barrel, a multi-loader barrel, a smooth barrel, a grooved barrel, a polygon barrel, a conical barrel, a drop barrel, an insert barrel, an add-on barrel and an exchangeable barrel.

9. Handgun according to claim 1, wherein the barrel is a drop barrel that can be tilted upon activation of a tilting mechanism, the tilting mechanism is triggered by a lever or slide arranged on the frame, wherein the lever or slide can also serve as a sight.

10. Handgun according to claim 1, characterized in that the glass breaker has at least one tip that is hardened.

11. Handgun according to claim 1, characterized in that the glass breaker is connected to a triggerable, force-actuated pulse generator.

12. Handgun according to claim 1, characterized in that the glass breaker is connected to a triggerable, force-actuated turning gear.

13. Handgun according to claim 1, wherein the belt cutter has a cutting gap with a V-shaped configuration with at least one cutting edge in the cutting gap.

14. Handgun according to claim 13, wherein the belt cutter has several cutting edges arranged in the cutting gap on each side of the V-shape.

15. Handgun according to claim 14, wherein the cutting edges have a serrated edge and/or a sawtooth edge.

16. Handgun according to claim 1, further comprising a drawer and one or more holding areas provided on the slide-in element configured to hold at least one piece of emergency equipment, at least one piece of medical equipment and/or at least one additional tool.

* * * * *